US005788060A

United States Patent [19]

Kuroda

[11] Patent Number: 5,788,060

[45] Date of Patent: Aug. 4, 1998

[54] EXTERNAL BUTTON SWITCH-INSTALLED STRUCTURE

[75] Inventor: Mitsuru Kuroda, Shizuoka, Japan

[73] Assignee: NEC Corporation, Tokyo, Japan

[21] Appl. No.: 634,388

[22] Filed: Apr. 18, 1996

[30] Foreign Application Priority Data

Apr. 19, 1995 [JP] Japan ..... 7-093441

[51] Int. Cl.[6] ..... H01H 3/12

[52] U.S. Cl. ..... 200/343

[58] Field of Search ..... 200/343, 345, 200/517

[56] References Cited

U.S. PATENT DOCUMENTS

| | | | |
|---|---|---|---|
| 4,029,916 | 6/1977 | Chu | 200/517 X |
| 4,532,393 | 7/1985 | Koizumi et al. | 200/343 |
| 4,582,967 | 4/1986 | Brumit et al. | 200/517 X |
| 4,638,151 | 1/1987 | Suwa | 200/517 X |
| 4,772,769 | 9/1988 | Shumate | 200/314 |

FOREIGN PATENT DOCUMENTS

| | | |
|---|---|---|
| 60-172246 | 11/1985 | Japan . |
| 2-247922 | 10/1990 | Japan . |
| 1218480 | 1/1971 | United Kingdom . |
| 1305896 | 2/1973 | United Kingdom . |

*Primary Examiner*—Renee S. Luebke

*Attorney, Agent, or Firm*—Sughrue, Mion, Zinn, Macpeak & Seas, PLLC

[57] ABSTRACT

A case has a pair of ribs and a hole for holding an external switch button, formed therein. The external switch button is provided with an actuating section for actuating an internal press-button switch, an arm section capable of being elastically deformed to allow movement of the actuating section, and a supporting section which is sandwiched between the pair of ribs.

6 Claims, 6 Drawing Sheets

EXTERNAL BUTTON SWITCH-INSTALLED STRUCTURE

BACKGROUND OF THE INVENTION

1. Field of the Invention

The present invention relates to an external button switch-button installation structure, and more particularly to an external switch-button installation structure disposed through a housing for compact electronic equipment.

2. Description of the Related Art

External button switches of the prior art are located at the side or the top surface of internal press-button switches in such a manner that the internal press-button switches are pressed down when the external button switches are pressed by the user. This type of external button switch is provided with an arm section engaged, in a freely rotatable manner, with a protrusion provided on the underside of a case. This type of external button switch structure is described in, for example, Japanese Unexamined Utility Model Law Application Disclosure SHO 60-172246 (JP-U-60-172246) and Japanese Unexamined Patent Application Disclosure HEI 2-247922 (JP-A-2-247922).

In order to anchor the arm section to the protrusion, the protrusion is fitted in a hole provided near the tip of the arm section, and the upper end of the protrusion is then welded fast by thermal deformation.

According to the prior art mentioned above, however, provision of special facilities for welding become necessary, and this requires an investment in the facilities and a site for installation of the facilities. Man-hours for installation of the facilities and money for their operation are required as well.

In addition, since the external switch and the arm section are integrally formed of a rigid polyacetal, the external button switch, when used in a pager, contacts the internal press-button switch and produces noise when the pager vibrates to notify a user of an incoming call.

SUMMARY OF THE INVENTION

It is an object of the present invention to provide an improved external switch button installation structure which overcomes the problems described above.

It is another object of the present invention to provide an external button switch button installation structure which does not require any special facilities for fixing the external switch button.

It is yet another object of the present invention to provide an external switch button installation structure which does not produce noise when vibrated to notify a user of an incoming call.

The external switch button installation structure according to the present invention comprises a member having a pair of ribs and an external press-button switch; an actuating section for actuating an internal press-button switch; an elastically deformable arm section which allows movement of the actuating section; and a supporting section which is an end of the arm section and engages with the pair of ribs to support the actuating section, wherein the external switch button is fixed by forcedly sandwiching the supporting section between the pair of ribs.

It is preferred that a recess section be provided between the pair of ribs in such a manner that an end of the supporting section engages with the recess section.

It is also preferred that the actuating section be constructed of a soft, luminous resin, and the arm section and the supporting section be constructed of a polycarbonate resin.

It is also advisable to provide the pair of ribs near a sidewall of the member to forcedly sandwich the supporting section between the sidewall and the pair of ribs.

The supporting section is preferred to be tapered or rectangular.

Since the force provided by the elasticity of the sandwiching ribs is utilized to hold the external button switch according to the present invention, it is easy to hold it.

In addition, the construction of the actuating section of the external switch button with a soft, luminous resin prevents noise due to-Vibration and allows increased visibility in dark places.

BRIEF DESCRIPTION OF THE DRAWINGS

These and-other objects, features and advantages of this invention will become more fully apparent from the following detailed description when taken with the accompanying drawings in which.

DESCRIPTION OF THE PREFERRED EMBODIMENTS

First, to facilitate the understanding of the present invention, a prior art will be described with reference to FIG. 1.

Figure 1:
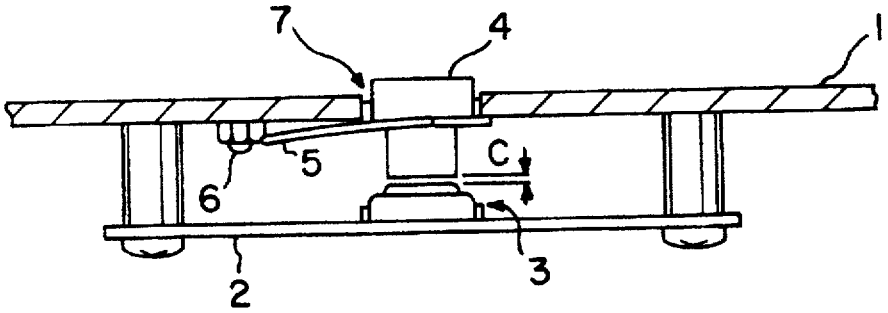
FIG. 1 PRIOR ART
FIG. 1 is a longitudinal sectional view of the main portion of a conventional, external switch button installation structure for electronic equipment.

FIG. 1 is a longitudinal sectional view of the main portion of a conventional external switch button installation structure for electronic equipment.

In FIG. 1, the tip of an arm section 5 made of a polyacetal resin, formed integrally with an external switch button 4, is engaged with a protrusion 6 provided on the underside of a case cover 1, with the tip of the protrusion 6 being fixed by welding. The external switch button 4 has a top surface jutting through a hole 7 of the case cover 1, and an internal bottom surface at a distance C from a pressbutton switch 3 placed on a board 2. When the external switch button 4 is pressed down by the user, the bottom surface of the external switch button 4 in turn presses down the internal press-button switch 3.

This type of external switch button installation structure requires facilities for welding to fix the arm section to the protrusion-as described above. In addition, since a rigid polyacetal resin is used to make up the structure, noise is produced by vibration, etc.

The present invention will now be explained in detail with reference to FIGS. 2 through 7.

Figure 2:
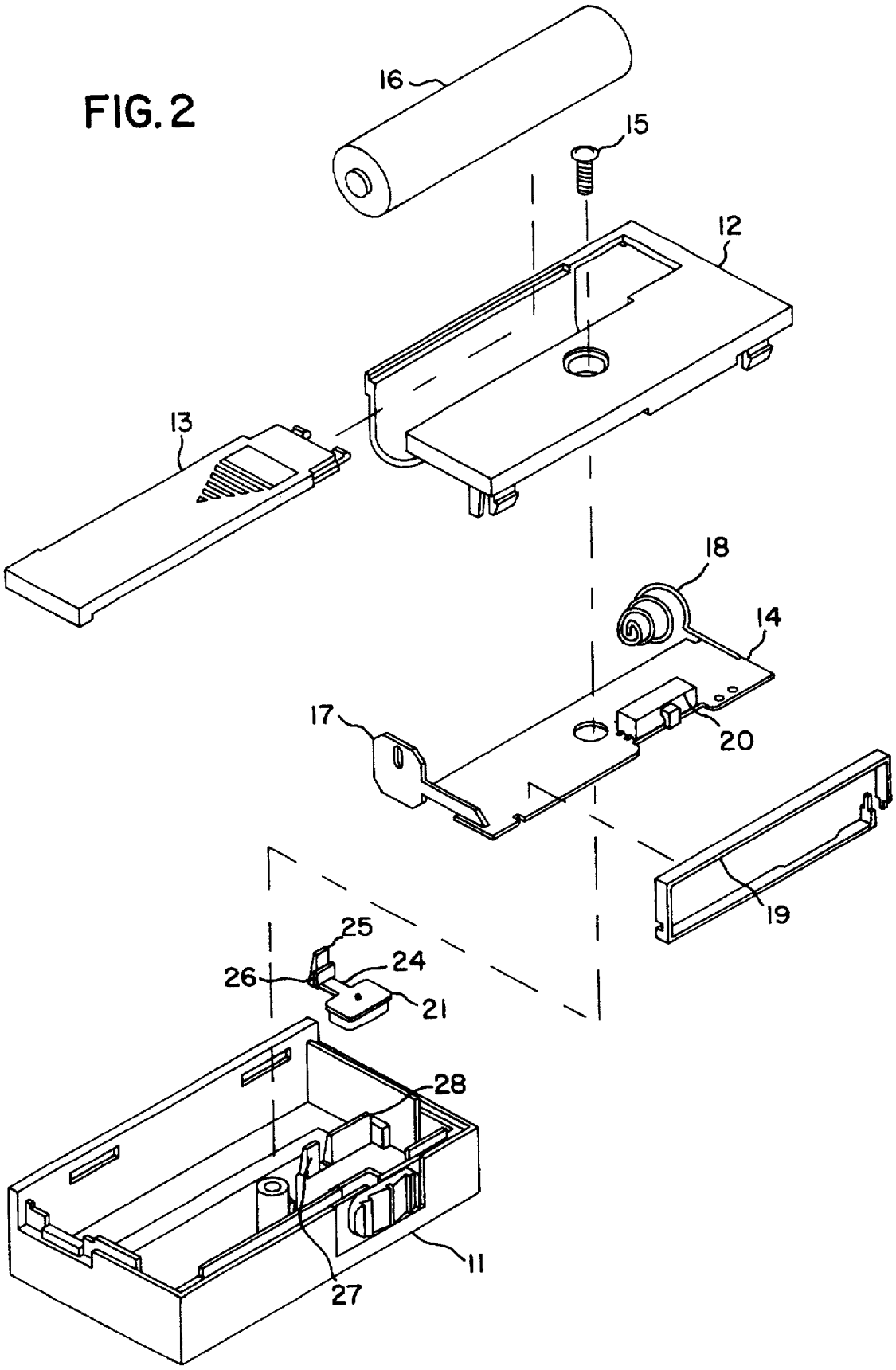
FIG. 2 is an expanded perspective view of the underside of an inter-call receiver for explanation of an embodiment of the external switch button installation structure for use in inter-call receivers.

FIG. 2 is an expanded perspective view of the underside of an inter-call receiver, for explanation of an embodiment of the external switch button installation structure for use in inter-call receivers.

In FIG. 2, the inter-call receiver comprises a case 11, a cover 12 and a battery cover 13. The case 11 and the cover 12 are connected to each other with a screw 15 so as to house a board 14. The board 14 is provided with a positive terminal 17 and a negative terminal 18 which come into contact with the positive and negative terminals of a battery 16. An antenna 19 is anchored to the board 14. The board 14 is also provided with an internal press-button switch 20.

An external switch button 21 is placed at a location which allows its contact the internal button switch 20 mounted on the board 14.

Figure 3:
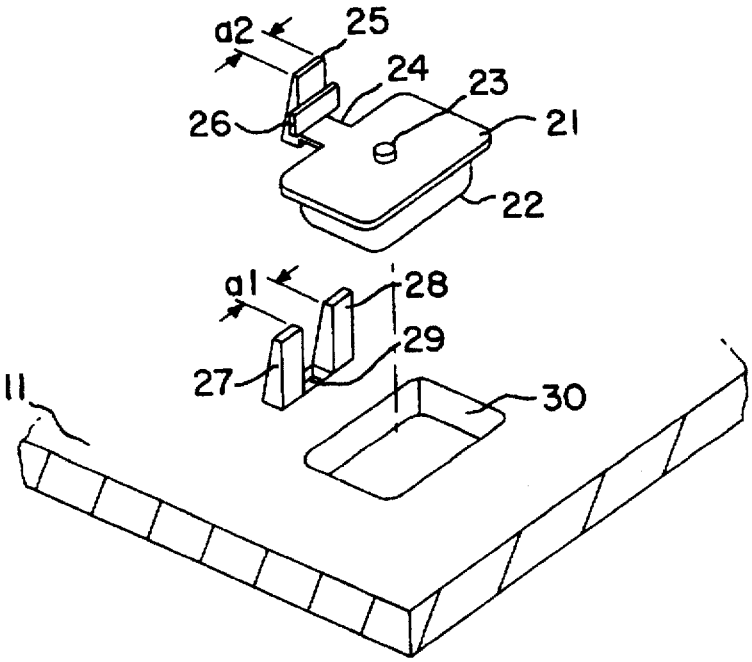
FIG. 3 is an enlarged, expanded perspective view of the external button switch-installed structure shown in FIG. 2.

FIG. 3 is an enlarged, expanded perspective view of the structure of the external switch button 21 installation, which is shown in FIG. 2.

In FIG. 3, the external button switch button 21 is equipped with an actuating section 22, a protruding section 23, an arm section 24, a rib 25 and a plate rib 26. The arm section 24 is almost in the same plane as that of the external switch button 21, and its end is provided with the tapered rib 25 of a size a2 slightly greater than the spacing al between plate ribs 27 and 28. Placed at the side of the protruding section 23 of the tapered rib 25 is the plate rib 26 one surface of which is in contact with the pair of ribs 27 and 28, and which has a width greater than a2, and is integrally constructed therewith by molding a resin.

The actuating section 22 of the structure with the external installed 21 installed is prepared by injection molding of a soft, luminous resin material. The luminous resin material is, for example, an elastomer, and preferably PANDEX T-1690 (trade name of DAINIPPON INK & CHEMICALS, INC.). The surface of the actuating section 22 which juts out of the case 11 includes notes and marks, and the opposite surface has a protruding section 23 for actuating the internal press-button switch 20.

The arm section 24, the protruding section 23 and the plate rib 26 are constructed of a rigid polycarbonate or the like, preferably PANLITE L-1225Z (trade name of TEIJIN CHEMICALS LTD.).

Thus the structure with the external switch button 21 is integrally molded from two different types of resins into what is known as a two-tone molding. Since this structure is visible due to luminescence of the actuating section 22 even when the inter-call receiver is used in dark places, its operability is not impaired. In addition, even when a vibrator (not shown) for notifying the user of incoming calls by vibration is activated, noise due to vibration which is caused by contact between the protruding section 23 of the actuating section 22 and the internal press-button switch 5 may be prevented, since the actuating section 22 is constructed of a soft, luminous resin.

In contrast, the case 11 is constructed with the pair of plate ribs 27 and 28, a recess section 29, and a hole 30. The tapered plate ribs 27 and 28 provided with a predetermined proper spacing are constructed integrally with the case by molding a resin. The recess section 29 for insertion of the tapered rib 26 is provided between the plate ribs 27 and 28. The hole 30 is the hole for insertion of the actuating section 22 of the structure with the external switch button 21.

Incorporation of the structure with the installed external switch button 21 into the case 11 results in mounting of the actuating section 22 in the hole 30 of the case 11, and in placement of the bottom surface of the actuating section 22 almost at the same level as that of the external surface of the case 10. The tapered rib 25 is press-fitted between the pair of plate ribs 27 and 28. Here, since the spacing between the pair of plate ribs 27 and 28 is slightly smaller than the width of the tapered rib 25, the tapered rib 25 is housed in the recess section 29 under pressure due to the elasticity of the pair of plate ribs 27 and 28.

When the structure with the external switch button 21 is installed in the case 11 in this way, since the tapered rib 25 is securely held by the elasticity of the sandwiching pair of plate ribs 27 and 28, the external button switch 21 is prevented from coming out. The stability provided by the elasticity of the plate ribs 27, may be properly adjusted by adjustment of the spacing between the pair of plate ribs 27, 28, the width of the tapered rib 25, etc.

Pressing down of the actuating section 22 by the user produces torque around an end of the arm section 24. Here, since the same surface of the plate rib 26 is in contact with the pair of plate ribs 27 and 28, floating or coming-out of the external button switch 21 due to the pressing down of the actuating section 22 may be prevented.

Figure 4:
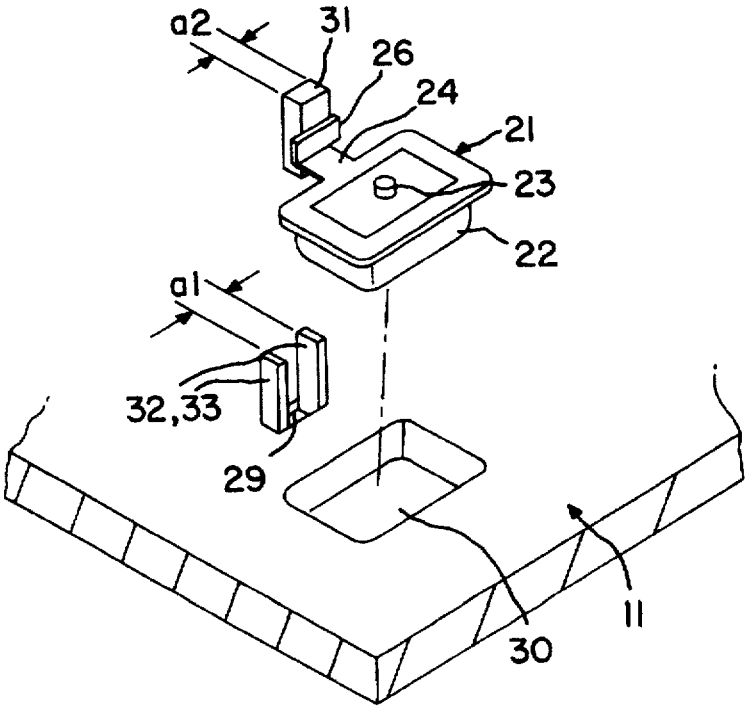
FIG. 4 is an enlarged perspective view of the main portion of another embodiment of the present invention.

FIG. 4 is an enlarged perspective view of the main portion of another embodiment of the present invention which is constructed by replacing the tapered rib shown in FIGS. 2 and 3 by a rectangular-section rib.

The embodiment shown in FIG. 4 is different from that shown in FIG. 3 in that rectangular-section ribs 31, 32 and 33 are used. Since the two embodiments are the same in other respects, further explanation is omitted regarding the former embodiment to avoid redundancy.

Figure 5A:
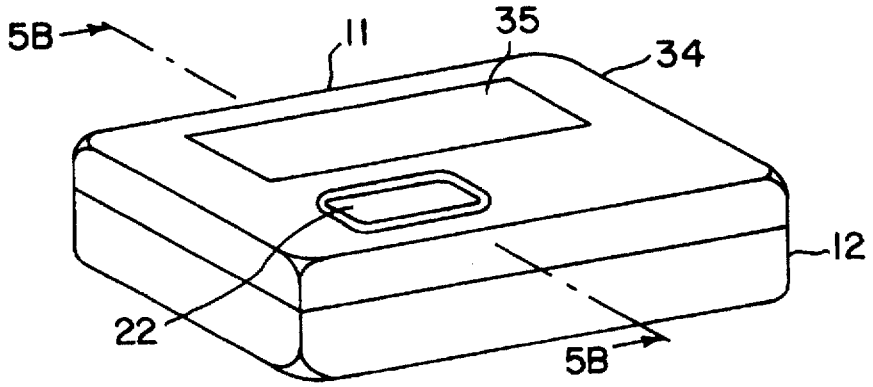
FIG. 5(*a*) is a view illustrative of the top surface of an inter-call receiver, and FIG. 5(*b*) is a cross sectional view taken along section A—A.
Figure 5B:
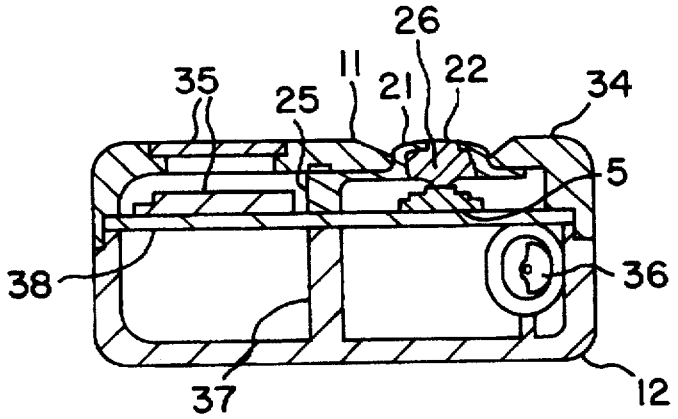

FIG. 5(*a*) is a view illustrative of the top surface of an inter-call receiver, and FIG. 5(*b*) is a cross sectional view taken along the section 5B—5B.

In FIGS. 5(*a*) and 5(*b*), a liquid crystal display section 35 is provided in the surface of the housing 34 of the inter-call receiver. A mark is presented on the actuating section 22 of the external switch button 21. A vibrator 36 is fixed inside the housing 34.

The rib 25 is held sandwiched between a printed board 38 and the case 11, pressed against a protruding section 37 of the cover 12.

Figure 6:
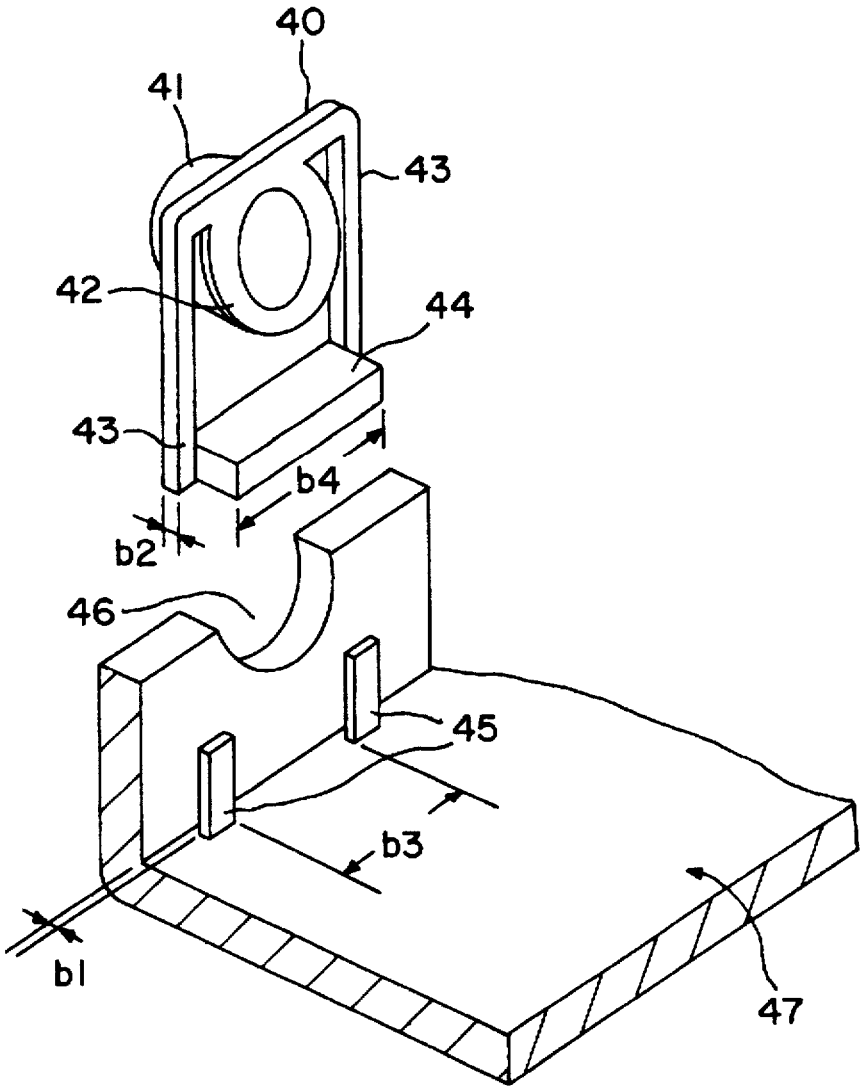
FIG. 6 is an enlarged view of the main portion of an external switch button.
Figure 7A:
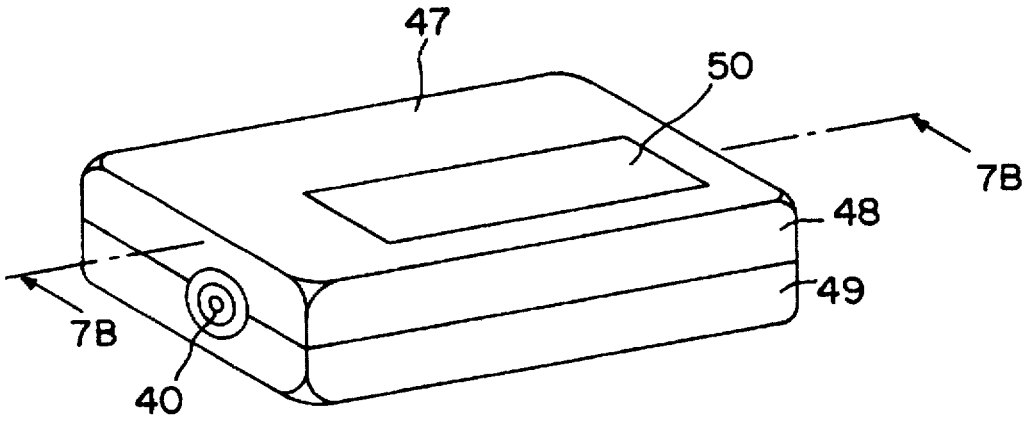
FIG. 7(*a*) is an external view of a housing, and FIG. 7(*b*) is a cross sectional view taken along section B—B. In the drawings, the same reference numerals denote the same structural elements.
Figure 7B:
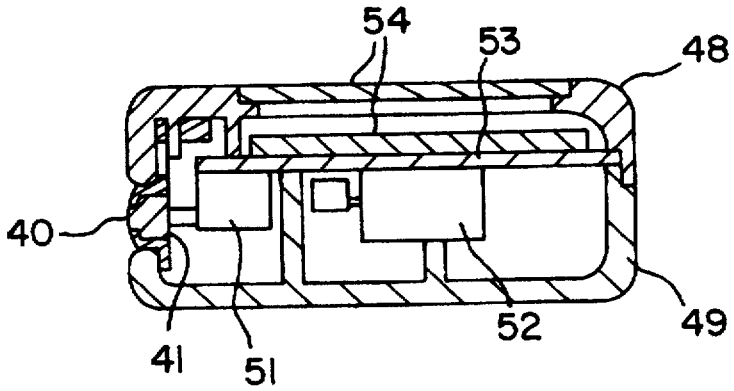

FIG. 6 and FIGS. 7(*a*) and 7(*b*) are views illustrative of an additional embodiment. FIG. 6 is an enlarged view of the main portion of an external switch button, FIG. 7(*a*) is an external view of the housing, and FIG. 7(*b*) is a cross sectional view taken along the section 7B—7B.

The case 47 of the inter-call receiver comprises a first housing 48 and a second housing 49, with a vibrator 52, a printed board 53 and a liquid crystal display section 54 placed inside. The external switch button 40 is brought into contact with the internal press-button switch 51.

A pair of parallel, elastically deformable ribs 45 are provided inside the case 47 at a given distance b1 from a sidewall thereof which has an open section 46 into which an actuating section 41 of a structure with an external switch button installed 40 installed may be pressed down for movement. The structure with the external switch button installed 40 installed has a flange-like bottom 42 of the cylindrical actuating section 41. The arm section 43 is long enough to allows its elastic deformation and to surround the bottom section 42 at given distances from the periphery of the bottom section 42, and has a width b2 slightly greater than the spacing bl between the sidewall of the case 47 and the rib 45. A base section 44 forms a connection between the ends of the arm section 43, and has a width b4 which is roughly as large as the spacing b3 between the pair of ribs 45.

Incorporation of the structure with the external switch button 40 into the case 47 results in mounting of the actuating section 41 in the open section 46 of the case 47, and in placement of the bottom surface of the actuating section 41 almost at the same level as that of the external surface of the case 47. When the arm section 43 is forced between the sidewall of the case and the pair of ribs 45 spaced therefrom with the spacing b1, the elasticity of the pair of ribs 45 produce a force which is exerted on the arm section 43, since the width b2 of the arm section 43 is slightly greater than the spacing b1. The base section 44 is positioned between the pair of ribs with a spacing b3 by bringing the bottom surface of the base section 44 into contact with the inside bottom surface of the case 47.

When the structure with the external switch button 40 is incorporated in the case 47 in this way, since the arm section 43 is securely held by the elasticity of the sandwiching pair of plate ribs 45, the external switch button 40 is prevented from coming out. The stability due to the elasticity may be properly adjusted by adjustment of the spacing between the pair of ribs 25, the width of the arm section 43, etc.

Pressing down of the actuating section 41 by the user produces torque around an end of the arm section 43. Here, since the bottom surface of the base section 44 is in contact with the case 47, floating or coming-out of the external switch button 40 due to the pressing down of the actuating section 41 may be prevented.

The foregoing embodiments were explained with particular reference to an inter-call receiver, but the present invention may be applied to other compact electronic equipment, without being limited thereto.

As explained above, the present invention allows easy and inexpensive installation of an external switch button through engagement due to the elasticity of ribs, etc.

In addition, since the external switch button is constructed of a soft, luminous resin, no noise is produced even in cases where a vibration section comprising a vibrator, etc. is provided, and further the external switch button is visible even in dark places.

While the invention has been described with reference to specific embodiments thereof, it will be appreciated by those skilled in the art that numerous variations, modifications, and embodiments are possible, and accordingly, all such variations, modifications and embodiments are to be regarded as being within the spirit and scope of the invention.

What is claimed is:

1. An electronic apparatus comprising:

a case comprising a member and an open section, said member having a pair of ribs with a predetermined spacing from each other; and an external switch button comprising an actuating section insertable into said open section, for actuating an internal press-button switch, an elastically-deformable arm section for allowing movement of said actuating section, and a supporting section at an end of said arm section, engageable with said pair of ribs to support said actuating section, a width of said supporting section being greater than said predetermined spacing;

wherein said external switch button is securable to said case by forcibly sandwiching said supporting section between said pair of ribs.

2. An electronic apparatus as claimed in claim 1, wherein a recess section is provided between said pair of ribs such that an end of said supporting section engages said recess section.

3. An electronic apparatus as claimed in claim 1, wherein said electronic apparatus is a receiver.

4. An electronic apparatus as claimed in claim 1, wherein said supporting section comprises a plate rib which abuts said pair of ribs when said external switch button is secured to said case, said plate rib being wider than said width of said support section.

5. An electronic apparatus as claimed in claim 1, wherein said actuating section is constructed of a soft, luminous resin.

6. An electronic apparatus as claimed in claim 5, wherein said arm section and said supporting section are constructed of a polycarbonate resin.

* * * * *